United States Patent [19]

MacIntosh

[11] 4,367,793

[45] Jan. 11, 1983

[54] UNIVERSAL RADIATOR ASSEMBLY

[76] Inventor: John J. MacIntosh, 10269 Choiceana Rd., Hesperia, Calif. 92345

[21] Appl. No.: 778,877

[22] Filed: Mar. 18, 1977

[51] Int. Cl.[3] ..... F28D 1/04

[52] U.S. Cl. ..... 165/151; 180/68 R

[58] Field of Search ..... 165/148–152, 165/76, 77, 140; 180/68 R; 285/419, 424

[56] References Cited

U.S. PATENT DOCUMENTS

| | | | |
|---|---|---|---|
| 540,827 | 6/1895 | Avery | 285/424 X |
| 1,087,519 | 2/1915 | White | 180/68 R |
| 2,258,911 | 10/1941 | Skoku | 285/424 |
| 2,322,047 | 6/1943 | Mormile | 165/148 X |
| 2,501,709 | 3/1950 | Booth | 165/76 X |
| 2,611,586 | 9/1952 | Collins | 165/140 |
| 2,887,097 | 5/1959 | Huffman, Sr. et al. | 165/140 |
| 3,246,691 | 4/1966 | La Porte et al. | 165/151 |

*Primary Examiner*—William R. Cline
*Assistant Examiner*—Theophil W. Streule, Jr.
*Attorney, Agent, or Firm*—Poms, Smith, Lande & Rose

[57] ABSTRACT

The present universal radiator assembly is intended to accommodate or to be used as a replacement for many different types of automobile radiators. The main assembly includes a conventional radiator core and two semi-cylindrical tanks made from sheet metal. The tnaks may be partially formed and then the flat side of each tank may be soldered into position to permit free passage of fluids from the radiator core into the tanks. Then the free edges of the sheet metals member may be bent around into engagement with one another. These edges are severely bent or flanged, and are locked into engagement with a longitudinal lock rod of triangular cross-section which is open on one side. The tanks are then longitudinally soldered along the mating edges. The four ends of the two semi-cylindrical tanks are closed by mounting flanges having a large central aperture. For use as replacements in the older style cars having upright radiators, the tanks are mounted wiht one tank at the top and the other tank at the bottom of the assembly and suitable inlet and outlet fittings are bolted to the mounting flanges, with gaskets sealing the assembly. Different inlet and outlet fittings may be employed to accommodate the particular design of automobiles for which the radiator is a replacement. With the newer type of cross-flow radiators, the two tanks are mounted with one tank located at one side and the other tank located at the other side of the assembly and inlet and outlet fittings are again mounted at the ends of the tanks to the mounting flanges mentioned above. The filler inlet forms part of the inlet fitting, and the fittings are differently oriented, of course, for the upright as compared with the cross-flow radiator assemblys, with the filler inlet oriented vertically, of course. Apertured mounting flanges having mounting slots are provided on two or on all four sides of the radiator assembly for flexibility in securing the radiator in any vehicle. In addition, telescoping mounting brackets provide additional flexibility in securing the radiator in position on any type of automobile.

2 Claims, 5 Drawing Figures

UNIVERSAL RADIATOR ASSEMBLY

BACKGROUND OF THE INVENTION

This invention relates to replacement type radiators.

At the present time when the core of an automobile radiator develops a leak, the radiator repair serviceman must order a new radiator core. These radiator cores come in more than four thousand different sizes. These various sizes are listed, for example, in catalogue number 1976, copyright 1976, of the Eskimo Radiator Manufacturing Company, of 6309 South Central Avenue, Los Angeles, Calif., 90001. Following the obtaining of a properly dimensioned core, the radiator service man must remove the two tanks and associated header plates which are secured to the old radiator. The header plates are first soldered to the new core. Then the tanks are soldered back onto the header plates, thus completing the assembly including the core, the upper and lower header plartes, and the upper and lower tanks.

A principal object of the present invention is to simplify and reduce the time required for the complete replacement of radiators, once a customer with a leaky radiator arrives at the shop.

SUMMARY OF THE INVENTION

Initially, instead of having to order radiator cores from central supply because of the four thousand or five thousand or more different types of radiator cores which are used in commercial vehicles, only a few sizes, such as six or seven standard sizes of radiators would be stocked, and these would be assembled complete with the tanks at each end of the core. The only steps which would be necessary in order to customize the installation to the particular car would be the addition of suitable inlet and outlet fittings having properly oriented filler inlets and the like. Then, merely by tightening a dozen nuts the radiator would be ready for installation, and this may be quickly accomplished by using the universal mounting strips and telescoping mounting brackets which are provided on each radiator assembly.

Accordingly, using the principles of the present invention, there would be no need to obtain radiators from a central location, and no special soldering or the like would have to be undertaken following receipt of the core from a central warehouse.

In accordance with a specific feature of the invention, a sheet metal lock rod, having a hollow triangular cross-section and open along one edge, is employed in the course of forming a radiator tank from a sheet metal member to fasten each of the tanks along its longitudinal seam.

In accordance with a broad aspect of the invention, standard size radiators are prefabricated with tanks mounted at each end of the core, and quick attachment members, such as apertured mounting flanges are secured to each end of the tanks. Then, a large range of different types of inlet and outlet connections are provided to accommodate the coolant connections needed for each individual make of car. These inlet and outlets may be provided with matching flanges so that the radiator assembly required for each automobile may be custom made merely by assembling inlets, outlets, and sealing caps to the four ends of the two tanks of the universal radiator assembly.

An additional subordinate aspect of the invention involves the location of the filler inlet and cap on the hose inlet fitting, so that it may be oriented in the vertical direction for either a cross-flow or an upright radiator installation.

In accordance with a collateral feature of the invention, flanged or channel shaped mounting brackets may extend along both sides of the core from one end of one tank to a corresponding end of the second tank to provide a structurally sound radiator assembly. Additional flexibility may be provided by slotted holes, or friction engagement means located along the flanged mounting brackets.

In accordance with another aspect of the invention, telescoping mounting brackets may be employed to facilitate mounting the radiators securely in position regardless of the location of the mounting holes in the automobile being repaired.

Other objects, features, and advantages of the present invention will become apparent from a consideration of the following detailed description and from the associated drawings.

DETAILED DESCRIPTION

Figure 1:
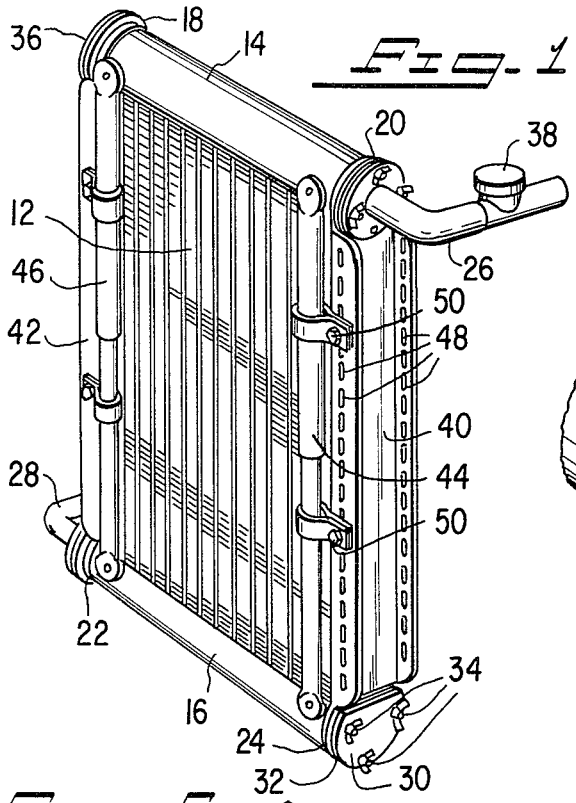
FIG. 1 shows a universal radiator assembly in the upright configuration, illustrating the principles of the invention.

With reference to the drawings, FIG. 1 shows the universal radiator assembly of the present invention employed in an upright configuration. By way of contrast, different positioning of the tanks and filler inlet in the cross-flow type radiator arrangement of FIG. 4 may be briefly noted.

In FIG. 1 the central core 12 is provided with two tanks 14 and 16 to which the vertically extending tubes of the core 12 are sealed. The tank 14 is provided with two mounting flanges 18 and 20, located at its two ends. Similarly, the lower tank 16 is provided with mounting flanges 22 and 24, at its two ends. Coolant connections to the engine are provided through the inlet fitting 26 which is bolted to mounting flange 20, and outlet fitting 28 which is bolted to flange 22. The other end of tank 16 is sealed by cap 30 which compresses a gasket 32 as a result of pressure applied by wing nuts 34. A similar closure cap 36 is secured in a like manner to the upper left hand of tank 14 as shown in FIG. 1. Similarly, inlet 26 and outlet 28 make sealing engagement with the respective flanges at the ends of the tanks to which they are secured. As discussed below, the flanges 18, 20 with the attached threaded fasteners, and the matching flanges and holes on the fittings provide quick-attachment arrangements, which facilitate speedy radiator service and installation.

It may also be noted that the inlet filler cap 38 and the inlet fitting 26 are selected and oriented so that the filler inlet and cap 38 faces upwardly rather than to one side.

At the two sides of the core 12 are the radiator frame and mounting members 40 and 42. These members 40 are secured at each of their ends to the tanks 14 and 16. To facilitate mounting the radiator assembly in any vehicle, the telescopic mounting brackets 44 and 46 are provided and these are secured respectively to the frame and mounting members 40 and 42. The telescoping mounting brackets 42 and 44 are provided with bolt or screw holes at each end, and the distance between these screw holes may be adjusted by telescoping one of the two members making up mounting bracket 42 or 44 within the other. In addition, slight additional lateral movement of mounting brackets 44 may be provided by the slots 48 in the frame and mounting members 40. If bolts 50 are not fully tightened, additional latitude is provided for easily securing mounting brackets 44 to the frame or other easily accessible portions of the automobile being repaired. Thereafter, the bolts 50 may be tightened. Additional brackets such as that shown at 52 in FIG. 5 may extend along the outside of each of the tanks 14 and 16 to provide additional flexibility in mounting the radiator in position on the vehicle to be repaired.

Figure 2:
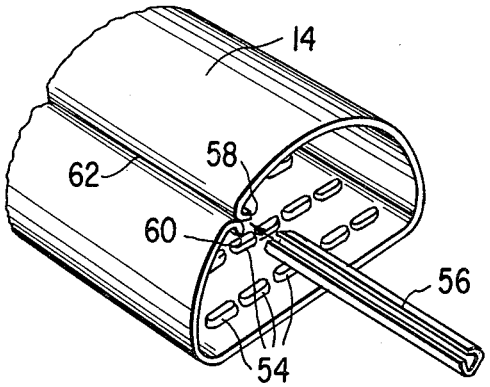
FIG. 2 is a fragmentary view showing the semicylindrical sheet metal tank and lock rod assembly which may be employed in implementing the invention.

FIG. 2 shows one of the semi-cylindrical tanks 14 in greater detail. In practice the tanks 14 are made of sheet metal members which are initially bent part way toward the configuration shown in FIG. 2, but are not closed to permit easy access for soldering. The holes 54 may be punched simultaneously with forming the flat side on the sheet metal member, or subsequently as determined by ease in fabrication. The metal around the holes 54, as shown in FIG. 2, is then soldered to the protruding ends of the core 12 prior to fully closing the sheet metal tank as shown in FIG. 2. The tank 14 is then bent the rest of the way to the configuration shown in FIG. 2 and the lock rod 56 is slid over the flanged edges 58 and 60 of the tank 14, forming the tight seam 62. This seam 62 is then soldered to completely seal tank 14 against leaks. The lock rod 56 may have any closed hollow cross-sectional configuration, but should have a gap equal to about twice the thickness of the sheel metal member 14 and sufficient inner space to accommodate edges 58 and 60.

The next steps in the assembly can best be described in connection with the exploded view of FIG. 3. Thus, following the assembly of the tank 14 to the core 12, the member 42 with its attached threaded screws 64 and semi-circular ring member 66 is passed over the tank 14 and secured in position along with the flanged end plate 18. The closure 36 is then bolted into place as shown in FIG. 1.

Figure 3:
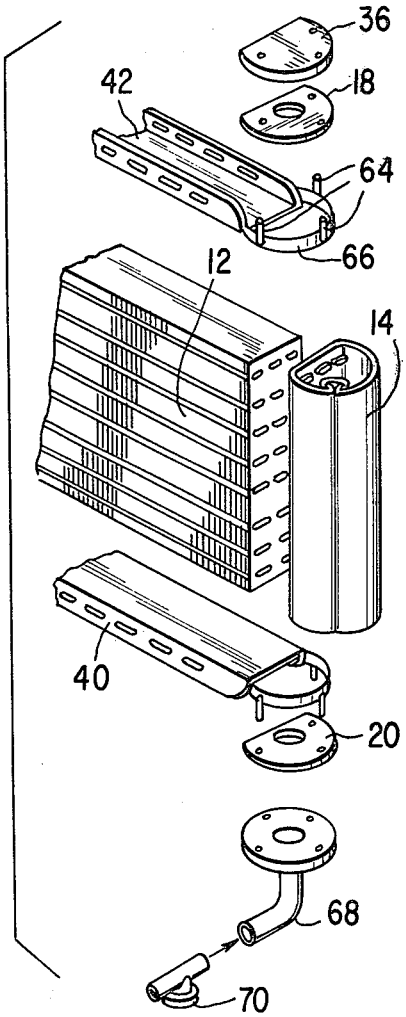
FIG. 3 is a partial exploded view of one end of a radiator assembly.

At the lower end of the tank 14 as shown in FIG. 3, the mounting flange 20 is secured to the other end of tank 14 in a similar manner. An additional fitting 68 and filler inlet and cap 70 is included in the exploded view of FIG. 3, with the fitting 68 being intended for securing to the mounting flange 20 by wing nuts as described above in connection with FIG. 1. It is noted in passing that the gaskets which would be employed to secure the closure 36 to the mounting flange 18, and to secure the fitting 68 to the mounting plate 20 in a leakproof manner, are not shown in FIG. 3.

Figure 4:
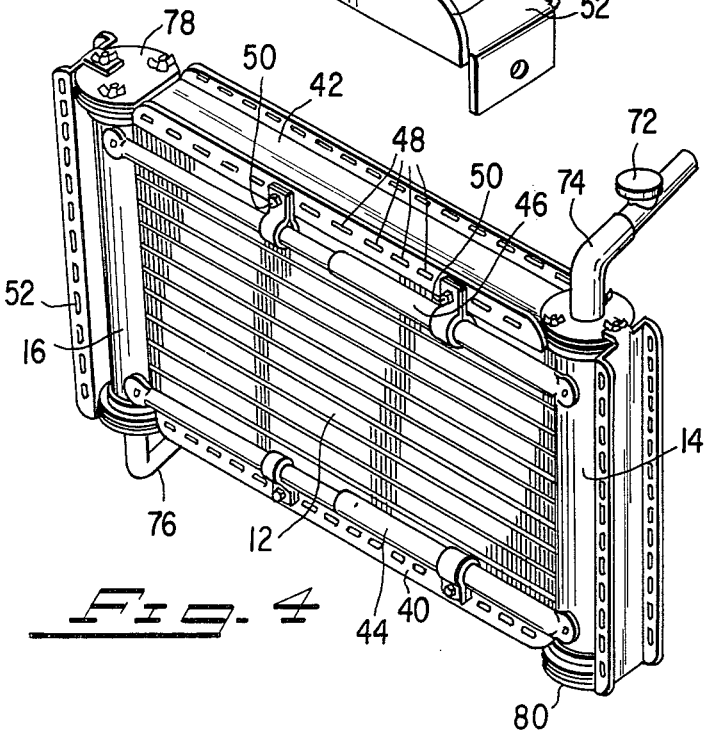
FIG. 4 is a view of a cross-flow type radiator.

FIG. 4 shows a radiator core 12 mounted in a "cross-flow" arrangement of a type that is used in certain higher performance automobiles. The assembly at FIG. 4 is very similar to that of FIG. 1, and this is indicated by the application of corresponding reference numerals to the two figures. Of course the filler inlet 72 must be oriented to receive coolant from the vertical direction and this necessitates selection and orientation of an inlet 74 which is appropriate for a proper orientation of the filler cap 72 and the desired positioning of the inlet hose which must connect to fitting 74. Similarly outlet 76 must have the proper orientation and extent to transmit coolant back to the engine. Caps 78 and 80 make sealing engagement with the other ends of the tanks 14 and 16. In connection with the securing of the inlets and outlets to the tank flanges, it may be noted that the inlets and outlets are provided with four evenly spaced holes, and that the tank flanges are provided with three spaced screws to match three of the four holes, thus permitting alternative orientation of the inlet and outlet fittings.

Also shown in FIG. 4 is the support and mounting member 52 which can be employed together with a matching bracket adjacent tank 14 for additional flexibility in securing the universal radiator assembly in position.

Figure 5:
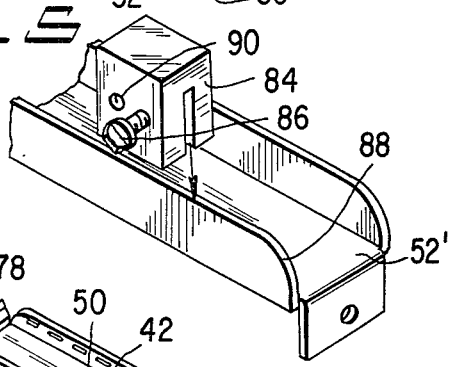
FIG. 5 shows an alternative or supplemental mounting bracket arrangement.

FIG. 5 shows an alternative arrangement for securing the nuts 50 to brackets such as those shown in FIG. 1 at 40 and 42. More specifically bracket assembly 52' as shown in FIG. 5 could be substituted for any of the brackets 40, 42, or 52 shown in FIGS. 1 and 4. It may be noted that the bracket 52' of FIG. 5 has no slots of the type shown at 48 in FIG. 1, or in the bracket 52 of FIG. 4. Instead, it is provided with two slidable adaptor members 84. This slidable adaptor 84 is provided with a screw 86 by which it is firmly attached to the side rail 88 of the mounting member 52'. The threaded hole 90 receives one of the bolts 50 as shown in FIG. 1 and FIG. 4 and thus permits universal lateral adjustment without the need for shifting bolt 50 from one of the slots 48 to another. In addition, it may be somewhat less expensive to provide four of the adapter elements 84 instead of the slots 48 in the frame and mounting members 40, 42, etc.

By way of completeness, reference is made to several known prior art patents including U.S. Pat. No. 1,548,591 to M. Firestone; U.S. Pat. No. 2,676,819 to F. M. Young, U.S. Pat. No. 3,497,936 to D. M. Donaldson; U.S. Pat. No. 3,689,972 to James A. Mosier et al; and U.S. Pat. No. 3,934,323 to F. A. Ford. While some of these patents have certain features which are in some way similar to my universal radiator assembly, none of the radiators shown in these prior patents appear to contemplate nor to achieve the purposes or structure described hereinabove. More specifically, it is again pointed out that in the normal conduct of the radiator repair business, it is necessary to maintain a central inventory of more than four thousand or five thousand different types of radiator cores. Further, after the radiator repair serviceman obtains the necessary core from a central warehouse, it is necessary to perform substantial and time consuming soldering work on the core to replace the header plates and the upper and lower tanks. With the universal radiator arrangements described in the present specification, it is only necessary to keep approximately six or seven different types of radiators on hand. These would range from a maximum size of approximately 36 by 18 inches which would be required for the largest cars, such as the Oldsmobile Toronado, down to 12 by 15 inches to fit the smallest cars such as the Sunbeam Sprite and the Datsun 110. Using a substantial assortment of inlets and outlets which can be quickly fastened onto the flanged tank ends, as described above, a complete radiator repair could be easily accomplished within one or two hours, instead of the several days which are sometimes required when the breakdown occurs in an isolated desert region.

In conclusion, it is to be understood that minor departures from the precise structures and methods shown and described herein are still to be encompassed by the present invention.

What is claimed is:

1. A universal radiator assembly for use as a replacement for automobiles having either upright or cross-flow type radiators, comprising:

a radiator core;

first and second tanks connected respectively to opposite ends of said radiator core in fluid sealing contact with said radiator;

selected separate inlet and outlet fittings having a configuration to match the radiator being replaced, said fittings including quick-attachment securing means;

mounting means located at each end of each of said tanks, including matching quick-attachment means for securing said selected inlet and outlet fittings in the desired orientation, to substantially correspond to the configuration of the radiator connections of the automobile radiator being replaced;

said mounting means including means for attaching and for releasing and permitting removal of said inlet and outlet fittings at room temperature, and reorienting of said inlet and outlet fittings or the substitution of new inlet and outlet fittings and the securing of said reoriented or new fittings to the ends of the tanks at from temperature; universal mounting means for mechanically securing said radiator into automobiles having many different radiator supporting arrangements, said universal mounting means including telescoping mounting brackets, and means for securing the parts of said telescoping brackets against relative movement with respect to each other.

2. A universal radiator assembly for use as a replacement for automobiles having either upright or cross-flow type radiators, comprising:

a radiator core;

first and second tanks connected respectively to opposite ends of said radiator core in fluid sealing contact with said radiator;

selected separate inlet and outlet fittings having a configuration to match the radiator being replaced, said fittings including quick-attachment securing means;

mounting means located at each end of each of said tanks, including matching quick-attachment means for securing said selected inlet and outlet fittings in the desired orientation, to substantially correspond to the configuration of the radiator connections of the automobile radiator being replaced;

said mounting means including means for attaching and for releasing and permitting removal of said inlet and outlet fittings at room temperature, and reorienting of said inlet and outlet fittings or the substitution of new inlet and outlet fittings and the securing of said reoriented or new fittings to the ends of the tanks at room temperature; universal mounting means for mechanically securing said radiator into automobiles having many different radiator supporting arrangements, said universal mounting means includes at least two frame members secured along the sides of said core and in firm engagement with both tanks, each said frame member being channel shaped and having at least one protruding flange; additional adjustable mounting means; and means for securing said additional adjustable mounting means selectively along the length of said protruding flange; said additional adjustable mounting means including two telescoping mounting brackets ; and means for securing the parts of said telescoping brackets against relative movement with respect to one another.

* * * * *